US010569572B2

(12) United States Patent
Oura

(10) Patent No.: US 10,569,572 B2
(45) Date of Patent: Feb. 25, 2020

(54) RELAY CONVEYANCE DEVICE

(71) Applicant: KYOCERA Document Solutions Inc., Osaka (JP)

(72) Inventor: Junichi Oura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/351,698

(22) Filed: Mar. 13, 2019

(65) Prior Publication Data

US 2019/0283462 A1 Sep. 19, 2019

(30) Foreign Application Priority Data

Mar. 15, 2018 (JP) ..... 2018-047531

(51) Int. Cl.
*B41J 11/00* (2006.01)
*B41J 13/00* (2006.01)

(52) U.S. Cl.
CPC ..... *B41J 11/002* (2013.01); *B41J 13/009* (2013.01)

(58) Field of Classification Search
CPC ..... B41J 11/002; B41J 13/009
See application file for complete search history.

(56) References Cited

U.S. PATENT DOCUMENTS

2018/0311975 A1* 11/2018 Kodama ..... B41J 11/0015
2019/0193425 A1* 6/2019 Kubo ..... B41J 29/38
2019/0248615 A1* 8/2019 Kubo ..... G03G 15/5029
2019/0263148 A1* 8/2019 Chike ..... B41J 13/025
2019/0283069 A1* 9/2019 Nakagaki ..... B41J 11/0015

FOREIGN PATENT DOCUMENTS

JP 2008-120048 A 5/2008

* cited by examiner

*Primary Examiner* — Huan H Tran
(74) *Attorney, Agent, or Firm* — Studebaker & Brackett PC

(57) ABSTRACT

A relay conveyance device includes a relay conveyance path, a processing unit, a main heater and a sub heater. The relay conveyance path is arranged between an image forming apparatus forming an image on a sheet and a post processing device carrying out post process to the sheet with the image formed by the image forming apparatus to convey the sheet from the image forming apparatus to the post processing device. The processing unit carries out predetermined process to the sheet at a predetermined position on the relay conveyance path. The main heater heats the sheet in processing in the processing unit. The sub heater heats the sheet in conveying at a position other than the predetermined position on the relay conveyance path. When an ink amount of the image formed on the sheet is less than a predetermined lower threshold, the sub heater is turned off.

7 Claims, 6 Drawing Sheets

RELAY CONVEYANCE DEVICE

INCORPORATION BY REFERENCE

This application is based on and claims the benefit of priority from Japanese Patent application No. 2018-047531 filed on Mar. 15, 2018, the entire contents of which are incorporated herein by reference.

BACKGROUND

The present disclosure relates to a relay conveyance device conveying a sheet from an image forming apparatus to a post processing device.

Conventionally, a relay conveyance device is known to relay and convey a sheet from an image forming apparatus forming an image on the sheet to a post processing device carrying out post-process of the sheet on which the image is formed by the image forming apparatus.

For example, a conventional ink-jet recording device (the image forming apparatus) includes a drying means drying an ink on a recording medium, a calculating means calculating a printing rate of image data recorded on the recording medium, a deciding means deciding whether or not the printing rate exceeds a standard value, and a driving means driving the drying means when the printing rate exceeds. If the printing rate is low, the ink on the recording medium is naturally dried.

The image forming apparatus, such as the above-mentioned ink-jet recording device dries the ink on the sheet, but cannot restrain curl caused in the sheet. Moreover, if the printing rate is low (an ink amount is small), because natural drying is carried out, it is not possible to shorten an interval time between the sheets. When the sheet is conveyed from such an image forming apparatus to the relay conveyance device, it is feared that malfunction sheet jam occurs due to the curl caused in the sheet. Moreover, when the ink amount is small, because the interval time between the sheets conveyed from the image forming apparatus to the relay conveyance device cannot be shortened, it is difficult to shorten the interval time between the sheets conveyed in the relay conveyance device.

SUMMARY

In accordance with the present disclosure, a relay conveyance device includes a relay conveyance path, a processing unit, a main heater and a sub heater. The relay conveyance path is arranged between an image forming apparatus forming an image on a sheet and a post processing device carrying out post process to the sheet with the image formed by the image forming apparatus to convey the sheet from the image forming apparatus to the post processing device. The processing unit carries out predetermined process to the sheet at a predetermined position on the relay conveyance path. The main heater heats the sheet in processing in the processing unit. The sub heater heats the sheet in conveying at a position other than the predetermined position on the relay conveyance path. When an ink amount of the image formed on the sheet is less than a predetermined lower threshold, the sub heater is turned off.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

A relay conveyance device 4 according to a first embodiment of the present disclosure will be described. First, structure of an image forming system 1 including the relay conveyance device 4 of the first embodiment will be described with reference to FIG. 1. Hereinafter, for convenience of description, it will be described so that the front side of the relay conveyance device 4 is positioned at a near side on a paper sheet of FIG. 1. Arrows L, R, U and Lo in each of the drawings respectively indicate a left side, a right side, an upper side and a lower side of the relay conveyance device 4.

The image forming system 1 includes an image forming apparatus 2 imaging an image on a sheet, a post processing device 3 carrying out post-process of the sheet on which the image is formed by the image forming apparatus 2, and the relay conveyance device 4 relaying and conveying the sheet from the image forming apparatus 2 to the post processing device 3.

Figure 1:
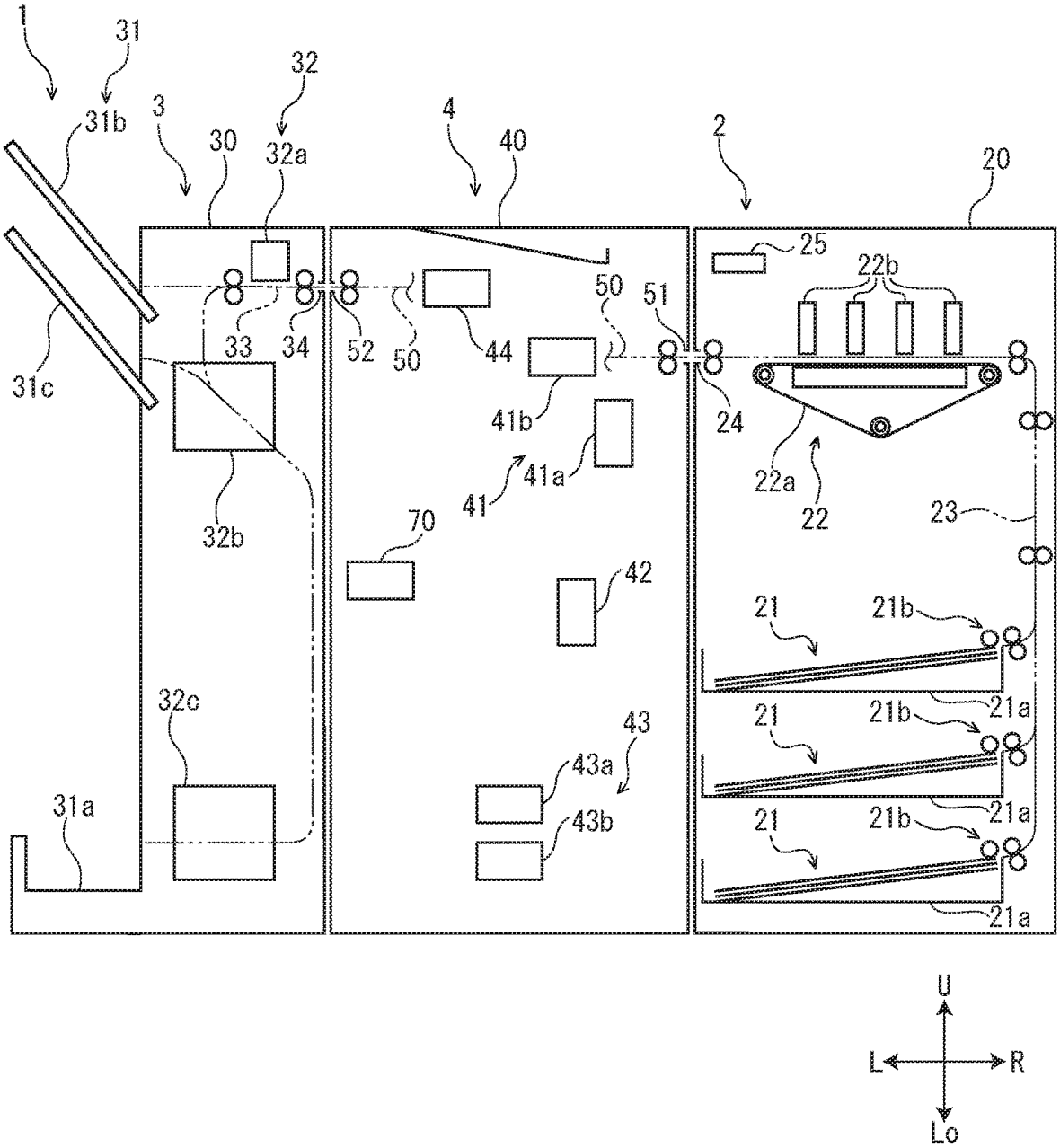
FIG. 1 is a sectional view schematically showing an image forming system including a relay conveyance device according to a first embodiment of the present disclosure.

Structure of the image forming apparatus 2 will be described with reference to FIG. 1. The image forming apparatus 2 includes a box-shape apparatus body 20, a plurality of sheet feeding parts 21 housed in a lower part of the apparatus body 20, and an image forming part 22 housed in an upper part of the apparatus body 20. The image forming apparatus 2 is, for example, a printer, a multifunction peripheral, or the like.

Inside the apparatus body 20, an upstream side conveyance path 23 conveying the sheet is provided. At a downstream end of the upstream side conveyance path 23, an upstream side ejecting port 24 is provided. The upstream side ejecting port 24 is opened in an upper part of a left face of the apparatus body 20 (a lateral face at a side of the relay conveyance device 4).

The plurality of sheet feeding parts 21 are located at an upstream end of the upstream side conveyance path 23. The plurality of sheet feeding parts 21 are juxtaposed in upward and downward directions. Each sheet feeding part 21 includes a sheet feeding cartridge 21*a* storing the sheet, and a sheet feeding mechanism 21*b* arranged at a right upper side of the sheet feeding cartridge 21*a*. The sheet is made of, for example, paper, synthetic resin or cloth.

The image forming part 22 is arranged at a middle-stream part of the upstream side conveyance path 23. The image forming part 22 adopts an ink-jet manner. The image forming part 22 includes a conveyance belt 22*a*, and four recording heads 22*b* arranged above the conveyance belt 22*a*. The conveyance belt 22*a* is wound around a plurality of rollers and rotatably supported. The respective recording heads 22*b* are provided so as to eject inks of different colors.

In addition, the image forming apparatus 2 includes a first control device 25 generally controlling each component of the image forming apparatus 2. The first control device 25 is composed of a controller, such as a CPU, and a storage, such as a ROM and a RAM. The controller controls each component connected to the first control device 25 on the basis of control programs and control data stored in the storage.

Figure 3:
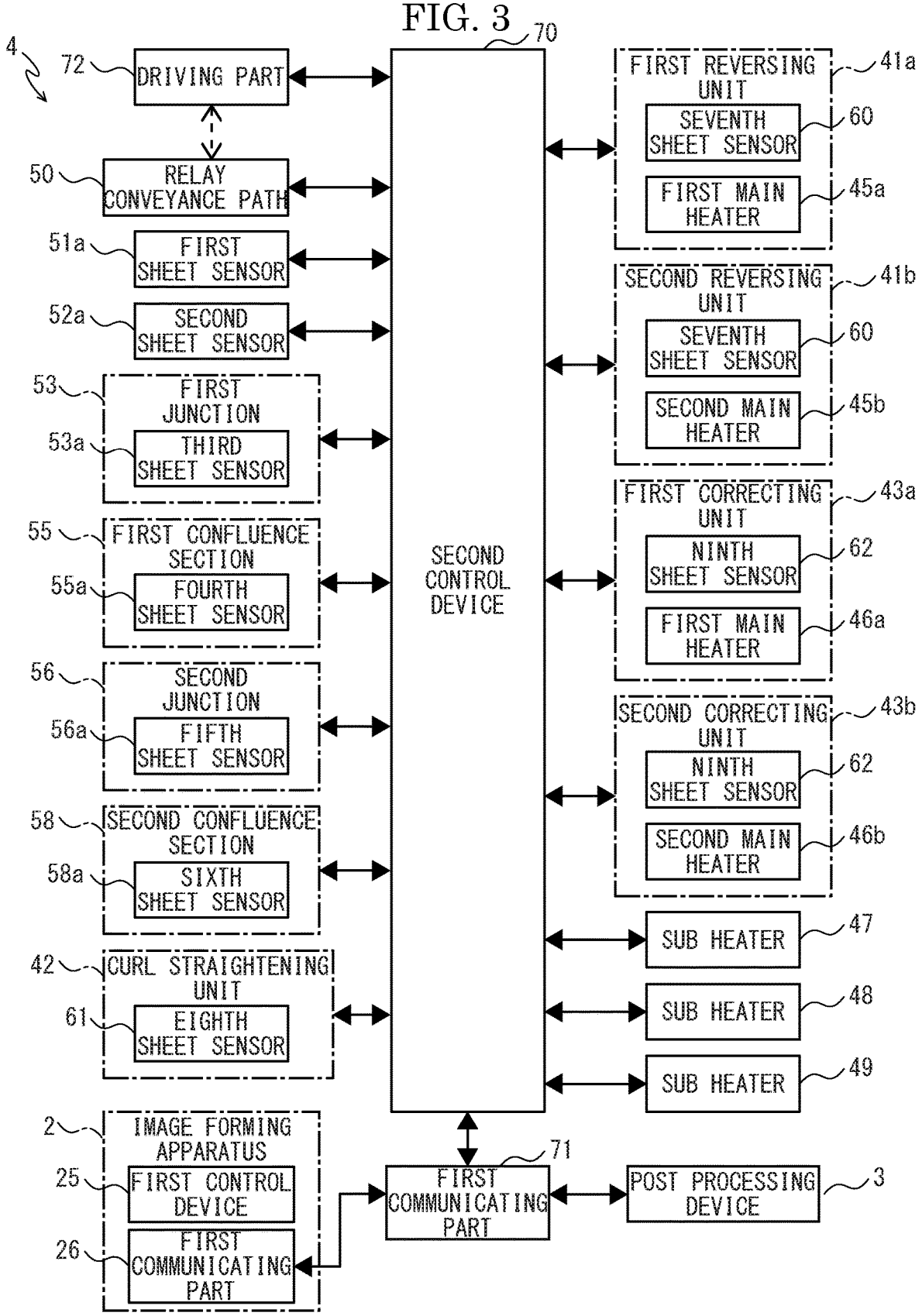
FIG. 3 is a block diagram showing structure of the relay conveyance device according to the first embodiment of the present disclosure.

The first control device 25 is, as shown in FIG. 3, connected to a first communicating part 26, and the first communicating part 26 is communicably connected to the post processing device 3 and the relay conveyance device 4. The first control device 25 transmits ink amount information to the relay conveyance device 4 via the first communicating part 26. For example, the ink amount information indicates a printing rate, a solid amount (a size of a solid portion), and others of the image formed on the sheet with respect to the sheet ejected from the upstream side ejecting port 24 to the relay conveyance device 4 after image forming. The first control device 25 calculates the ink amount information of the image, such as the printing rate and the solid amount, on the basis of data of a print object, such as image data inputted from an external computer or the like, or image data read from a document by a scanner. That is, the ink amount information indicates an ink amount used by each recording head 22*b*.

Next, operation of the image forming apparatus 2 will be described. First, in each sheet feeding part 21, the sheet feeding mechanism 21*b* picks up the sheet from the sheet feeding cartridge 21*a* and feeds out the sheet to the upstream side conveyance path 23. The sheet is conveyed on the upstream side conveyance path 23 to enter the image forming part 22. In the image forming part 22, the sheet is absorbed onto an upper face of the conveyance belt 22*a* and conveyed in accordance with rotation of the conveyance belt 22*a*. Each recording head 22*b* ejects the ink to the sheet absorbed on the upper face of the conveyance belt 22*a* from an upper side on the basis of the image data, thereby to form the image on the sheet. The sheet with the formed image is further conveyed on the upstream conveyance path 23 and ejected via the upstream side ejecting port 24.

Structure of the post processing device 3 will be described with reference to FIG. 1. The post processing device 3 includes a casing 30, a plurality of ejection trays 31 (a first ejection tray 31*a*, a second ejection tray 31*b*, a third ejection tray 31*c*) protruded from a left face of the casing 30, and a plurality of post processing mechanisms 32 (a first post processing mechanism 32*a*, a second post processing mechanism 32*b*, a third post processing mechanism 32*c*) housed in the casing 30.

Inside the casing 30, a downstream side conveyance path 33 conveying the sheet is provided. At an upstream end of the downstream side conveyance path 33, a downstream side introducing port 34 is provided. The downstream side introducing port 34 is opened in an upper part of a right face of the casing 30 (a lateral face at a side of the relay conveyance device 4).

The plurality of post processing mechanisms 32 includes, for example, the first post processing mechanism 32*a* having a punching function, the second post processing mechanism 32*b* having a staple function, and the third post processing mechanism 32*c* having a sheet folding function.

Next, operation of the post processing device 3 will be described. When the sheet with the image formed by the image forming apparatus 2 is ejected from the relay conveyance device 4 to the post processing device 3, the sheet is introduced to the downstream side conveyance path 33 via the downstream side introducing port 34. The sheet is conveyed to the first post processing mechanism 32*a* and, if necessary, is subjected to punching process. The sheet passed through the first post processing mechanism 32*a* is ejected to the second ejection tray 31*b* or is conveyed to second post processing mechanism 32*b*. The sheet conveyed to second post processing mechanism 32*b* and, if necessary, is subjected to staple process. The sheet passed through the second post processing mechanism 32*b* is ejected to the third ejection tray 31*c* or is conveyed to third post processing mechanism 32*c*. The sheet conveyed to third post processing mechanism 32*c* and, if necessary, is subjected to sheet folding process. The sheet passed through the third post processing mechanism 32*c* is ejected to the first ejection tray 31*a*.

Figure 2:
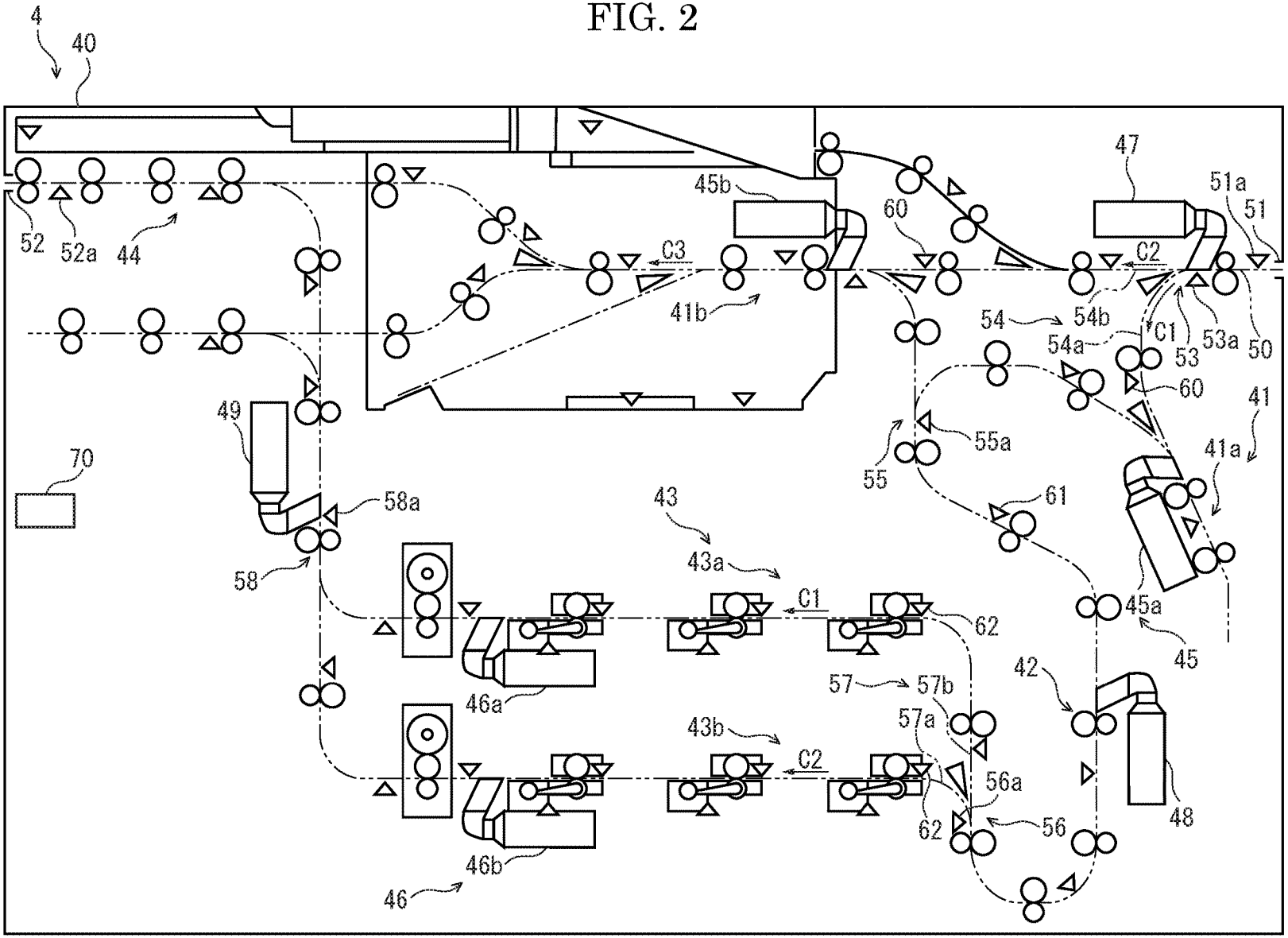
FIG. 2 is a sectional view schematically showing the relay conveyance device according to the first embodiment of the present disclosure.

Structure of the relay conveyance device 4 will be described with reference to FIGS. 1 and 2. The relay conveyance device 4 is a separate body from the image forming apparatus 2 and the post processing device 3 and is removably attached to them.

The relay conveyance device 4 includes a housing 40, a plurality of reversing units 41 (a process unit) housed in a right part and an upper part of the housing 40, a curl straightening unit 42 housed in a right lower part of the housing 40, a plurality of correcting units 43 (a process unit) housed in a lower part of the housing 40, and an accelerating unit 44 housed in a left upper part of the housing 40.

Inside the housing 40, a relay conveyance path 50 conveying the sheet is provided. The relay conveyance path 50 is arranged along the plurality of reversing units 41, the curl straightening unit 42, the plurality of correcting units 43 and the accelerating unit 44 between the upstream conveyance path 23 of the image forming apparatus 2 and the downstream side conveyance path 33 of the post processing device 3. Moreover, along the relay conveyance path 50, a plurality of pairs of rollers are provided, and the sheet introduced from the upstream conveyance path 23 to the relay conveyance device 4 is conveyed along the relay conveyance path 50 and ejected to the downstream side conveyance path 33.

The relay conveyance device 4 includes a plurality of main heaters 45 and 46, and a plurality of sub heaters 47, 48 and 49 in order to heat the sheet conveyed on the relay conveyance path 50.

The relay conveyance device 4 includes a second control device 70 controlling conveyance of the sheet on the relay conveyance path 50, operation of the plurality of reversing units 41, the curl straightening unit 42, the plurality of correcting units 43 and the accelerating unit 44, and heating of the plurality of main heaters 45 and 46 and the plurality of sub heaters 47, 48 and 49.

At an upstream end of the relay conveyance path 50, a relay introducing port 51 is provided. The relay introducing port 51 is opened in an upper part of a right face of the housing 40 (a lateral face at a side of the image forming apparatus 2) and arranged to face to the upstream side ejecting port 24 of the image forming apparatus 2. In the vicinity of the relay introducing port 51, a pair of introducing rollers are provided, and the sheet ejected from the upstream side ejecting port 24 is introduced to the relay conveyance path 50 via the relay introducing port 51. In the vicinity of the relay introducing port 51, a first sheet sensor 51*a* detecting the sheet introduced to the relay conveyance path 50 is provided, and the second control device 70 monitors detection result of the first sheet sensor 51*a*.

At a downstream end of the relay conveyance path 50, a relay ejecting port 52 is provided. The relay ejecting port 52 is opened in an upper part of a left face of the housing 40 (a lateral face at a side of the post processing device 3) and arranged to face to the downstream side introducing port 34 of the post processing device 3. In the vicinity of the relay ejecting port 52, a pair of ejecting rollers are provided, and the sheet conveyed on the relay conveyance path 50 is ejected to the downstream side introducing port 34 via the relay ejecting port 52. In the vicinity of the relay ejecting port 52, a second sheet sensor 52*a* detecting the sheet ejected from the relay conveyance path 50 is provided, and the second control device 70 monitors detection result of the second sheet sensor 52*a*.

At an upstream part of the relay conveyance path 50, a first branch section 53 is provided and the relay conveyance path 50 branches off at the first branch section 53 into a plurality of reverse paths 54 (a first reverse path 54*a* and a second reverse path 54*b*). The first branch section 53 is configured to have, for example, a branching pawl. The sheet introduced from the relay introducing port 51 to the relay conveyance path 50 is conveyed to the first reverse path 54*a* or the second reverse path 54*b* by the first branch section 53 controlled by the second control device 70. In the vicinity of the first branch section 53, a third sheet sensor 53*a* detecting the sheet reaching the first branch section 53 is provided, and the second control device 70 monitors detection result of the third sheet sensor 53*a*.

At a downstream side from the first junction 53 on the relay conveyance path 50, a first confluence section 55 is provided, and the first reverse path 54*a* and the second reverse path 54*b* join the relay conveyance path 50 at the first confluence section 55. In the vicinity of the first confluence section 55, a pair of confluence rollers are provided, and the sheet conveyed from the first reverse path 54*a* or the second reverse path 54*b* is conveyed to the first confluence section 55. In the vicinity of the first confluence section 55, a fourth sheet sensor 55*a* detecting the sheet reaching the first confluence section 55 from the first reverse path 54*a* or the second reverse path 54*b* is provided, and the second control device 70 monitors detection result of the fourth sheet sensor 55*a*.

At a downstream side from the first confluence section 55 (the curl straightening unit 42) on the relay conveyance path 50, a second branch section 56 is provided, and the relay conveyance path 50 branches off at the second branch section 56 into a plurality of correction paths 57 (a first correction path 57*a* and a second correction path 57*b*). The second branch section 56 is configured to have, for example, a branching pawl. The sheet conveyed from the first confluence section 55 along the relay conveyance path 50 is conveyed to the first correction path 57*a* or the second correction path 57*b* by the second branch section 56 controlled by the second control device 70. In the vicinity of the second branch section 56, a fifth sheet sensor 56*a* detecting the sheet reaching the second branch section 56 is provided, and the second control device 70 monitors detection result of the fifth sheet sensor 56*a*.

At a downstream side from the second junction 56 on the relay conveyance path 50, a second confluence section 58 is provided, and the first correction path 57*a* and the second correction path 57*b* join the relay conveyance path 50 at the second confluence section 58. In the vicinity of the second confluence section 58, a pair of confluence rollers are provided, and the sheet conveyed from the first correction path 57*a* or the second correction path 57*b* is conveyed to the second confluence section 58. In the vicinity of the second confluence section 58, a sixth sheet sensor 58*a* detecting the sheet reaching the second confluence section 58 from the first correction path 57*a* or the second correction path 57*b* is provided, and the second control device 70 monitors detection result of the sixth sheet sensor 58*a*.

In the relay conveyance path 50, a first conveyance path C1 from the relay introducing port 51 to the relay ejecting port 52 through the first reverse path 54*a* and the first correction path 57*a* and a second conveyance path C2 from the relay introducing port 51 to the relay ejecting port 52 through the second reverse path 54*b* and the second correction path 57*b* are set by the same length as each other.

Incidentally, in the relay conveyance path 50, an abbreviation path C3 conveying the sheet from the relay introducing port 51 to the accelerating unit 44 without passing through the plurality of reversing units 41, the curl straightening unit 42 and the plurality of correcting units 43 is provided. The abbreviation path C3 is arranged in the upper part of the housing 40 and is connected to the accelerating unit 44 with applying a part of the second reverse path 54*b*.

The plurality of reversing units 41 includes a first reversing unit 41*a* and a second reversing unit 41*b* respectively arranged on the first reverse path 54*a* and the second reverse path 54*b*. Each of the first reversing unit 41*a* and the second reversing unit 41*b* includes, for example, a reverse area and a pair of reversing rollers. When the sheet is conveyed from each of the first reverse path 54*a* and the second reverse path 54*b*, each of the first reversing unit 41*a* and the second reversing unit 41*b* positively rotates the pair of reversing rollers to introduce the sheet to the reverse area. Each of the first reversing unit 41*a* and the second reversing unit 41*b* temporarily stops the sheet at the reverse area, and then, negatively rotates the pair of reversing rollers to eject the sheet from the reverse area. At this time, a rear end of the sheet before reversing becomes a top end of the sheet ejected from the reverse area, that is, the top end and the rear end of the conveyed sheet are inverted.

In addition, on the first reverse path 54*a* and the second reverse path 54*b*, seventh sheet sensors 60 detecting the sheet introduced to the first reversing unit 41*a* and the second reversing unit 41*b* are respectively provided, and the second control device 70 monitors detection result of the seventh sheet sensors 60. Incidentally, on the first reverse path 54*a* and the second reverse path 54*b*, another sheet sensor detecting the sheet ejected from the first reversing unit 41*a* and the second reversing unit 41*b* may be provided, and in the first reversing unit 41*a* and the second reversing unit 41*b*, a further sheet sensor detecting the sheet in the reverse area may be provided.

The curl straightening unit 42 is arranged at a downstream side from the first reversing unit 41*a* and the second reversing unit 41*b* between the first confluence section 55 and the second junction 56 on the relay conveyance path 50. For example, the curl straightening unit 42 pressures the sheet passing through the relay conveyance path 50 from both of a surface side and a back-face side by a pair of straightening rollers, thereby to straighten the curl caused in the sheet. In the curl straightening unit 42, an eighth sheet sensor 61 detecting the sheet introduced in the curl straightening unit 42 is provided, and the second control device 70 monitors detection result of the eighth sheet sensor 61. Incidentally, in the curl straightening unit 42, another sheet sensor detecting the sheet in curl straightening may be provided.

The plurality of correcting units 43 respectively include a first correcting unit 43*a* and a second correcting unit 43*b* arranged in the first correction path 57*a* and the second correction path 57*b*, and are arranged at a downstream side from the curl straightening unit 42 on the relay conveyance path 50. For example, each of the first correcting unit 43*a* and the second correcting unit 43*b* includes a plurality of pairs of correcting rollers conveying the sheet on each of the first correction path 57*a* and the second correction path 57*b* to correct positions in forward and backward directions of the sheet by rotation and stop of each pair of the correcting rollers. In the first correcting unit 43*a* and the second correcting unit 43*b*, ninth sheet sensors 62 detecting the sheet introduced to the first correcting unit 43*a* and the second correcting unit 43*b* are respectively provided, and the second control device 70 monitors detection result of the ninth sheet sensors 62. Incidentally, in the first correcting unit 43*a* and the second correcting unit 43*b*, another sheet sensor detecting the sheet in position correcting may be provided.

The accelerating unit 44 is arranged between the second confluence section 58 and the relay ejecting port 52 on the relay conveyance path 50. For example, the accelerating unit 44 includes a plurality of pairs of accelerating rollers. Each pair of accelerating rollers are arranged at an upstream side from the pair of ejecting rollers of the relay ejecting port 52 on the relay conveyance path 50. Each pair of accelerating rollers accelerate conveyance speed of the sheet to convey the sheet to the relay ejecting port 52. In the accelerating unit 44, another sheet sensor detecting the sheet in accelerating may be provided.

Each sheet sensor described above may be used as a conveyance sensor detecting conveyance jam of the sheet, an accumulation sensor detection accumulation jam of the sheet, a position sensor detecting a home position (a position) of the sheet, and others. Moreover, inside the housing 40 of the relay conveyance device 4, in addition to each sheet sensor described above, conveyance sensors, accumulation sensors, and position sensors may be provided at various positions on the relay conveyance path 50. Further, inside the housing 40 of the relay conveyance device 4, interlock switches detecting attachment of various components, such as a cover removably attached to the relay conveyance device 4, may be provided.

The main heaters 45 and 46, and the plurality of sub heaters 47, 48 and 49 are heaters restraining curl caused in the sheet and drying the ink of the image formed on the sheet.

The main heaters 45 heat the sheet in the process units, such as the reversing units 41 and the correcting units 43, carrying out predetermined process to the sheet at predetermined positions on the relay conveyance path 50. For example, the main heaters 45 includes a first main heater 45*a* arranged in the first reversing unit 41*a* and a second main heater 45*b* arranged in the second reversing unit 41*b*. The first main heater 45*a* and the second main heater 45*b* are controlled by the second control device 70 and individually activated to heat the sheet in reversing (e.g. stopping) in the first reversing unit 41*a* and the second reversing unit 41*b*.

Moreover, the main heaters 46 includes a first main heater 46*a* arranged in the first correcting unit 43*a* and a second main heater 46*b* arranged in the second correcting unit 43*b*. The first main heater 46*a* and the second main heater 46*b* are controlled by the second control device 70 and individually activated to heat the sheet in position correcting (e.g. stopping) in the first correcting unit 43*a* and the second correcting unit 43*b*.

The sub heaters 47, 48 and 49 heat the sheet being conveyed at positions other than the predetermined positions of the process units corresponding to the main heaters 45 on the relay conveyance path 50. For example, the sub heater 47 is arranged at an upstream side from the first junction 53 on the relay conveyance path 50. The sub heater 48 is arranged at a downstream side from the first confluence section 55 and an upstream side from the curl straightening unit 42 on the relay conveyance path 50. The sub heater 49 is arranged at a downstream side from the second confluence section 58 and an upstream side from the accelerating unit 44 on the relay conveyance path 50. The sub heaters 47, 48 and 49 are controlled by the second control device 70 and individually activated to heat the sheet being conveyed on the relay conveyance path 50.

Next, the second control device 70 and its periphery will be described with reference to FIG. 3. The second control device 70 is composed of a controlling part, such as a central processing unit (CPU), and storages, such as a read only memory (ROM) and a random access memory (RAM). The second control device 70 is configured so that the controlling part controls each component connected to the second control device 70 on the basis of control programs and control data stored in the storages.

The second control device 70 is connected to a second communicating part 71, and the second communicating part 71 is communicably connected to the first communicating part 26 of the image forming apparatus 2 and the post processing device 3. The second control device 70 receives an ink amount of the image formed on the sheet introduced from the image forming apparatus 2 to the relay conveyance device 4 via the second communicating part 71 from the image forming apparatus 2.

In the storages of the second control device 70, for example, with respect to the ink amount of the image formed on the sheet, a predetermined lower threshold (e.g. 10% of a printing rate and 5% of a solid amount) and a predetermined upper threshold (e.g. 30% of a printing rate and 20% of a solid amount) are stored.

The second control device 70 is connected to, for example, the first sheet sensor 51*a*, the second sheet sensor 52*a*, the third sheet sensor 53*a*, the fourth sheet sensor 55*a*, the fifth sheet sensor 56*a*, the sixth sheet sensor 58*a*, the seventh sheet sensors 60, the eighth sheet sensor 61 and the ninth sheet sensors 62 to monitor detection results of these sheet sensors. Incidentally, although illustration is omitted, the second control device 70 is connected to other sheet sensors, conveyance sensors, accumulation sensors, position sensors and interlock switches to monitor detection results of the sensors and the switches.

Further, the second control device 70 is connected to a driving part 72 driving and rotating the above-described pairs of rollers (the pair of introducing rollers, the pair of ejecting rollers, the pair of confluence rollers, the pair of reversing rollers, the pair of straightening rollers, the pairs of correcting rollers, the pairs of accelerating rollers, and other conveying rollers) along the relay conveyance path 50. The second control device 70 controls the driving part 72 to rotate each pair of rollers, and thereby to convey the sheet. Particularly, the second control device 70 adjusts rotation drive force of the driving part 72 for each pair of rollers, and thereby, can control conveyance speed of the sheet. Incidentally, since the accelerating unit 44 (the pairs of accelerating rollers) accelerates the conveyance speed of the sheet faster than other portions of the relay conveyance path 50, another exclusive driving part different from the driving part 72 may be provided for the accelerating unit 44.

Moreover, the second control device 70 is connected to the first junction 53 and the second junction 56. The second control device 70 controls to the first junction 53 and the second junction 56 to switch a conveyance path for each sheet between the first conveyance path C1 through the first reverse path 54*a* and the first correction path 57*a* and the second conveyance path C2 through the second reverse path 54*b* and the second correction path 57*b*.

Further, the second control device 70 is connected to the first main heater 45*a* and the second main heater 45*b*, the first main heater 46*a* and the second main heater 46*b*, and the sub heaters 47, 48 and 49. The second control device 70 individually controls the first main heater 45*a* and the second main heater 45*b*, the first main heater 46*a* and the second main heater 46*b*, and the sub heaters 47, 48 and 49 to control turning on and off of the heaters.

Figure 4:
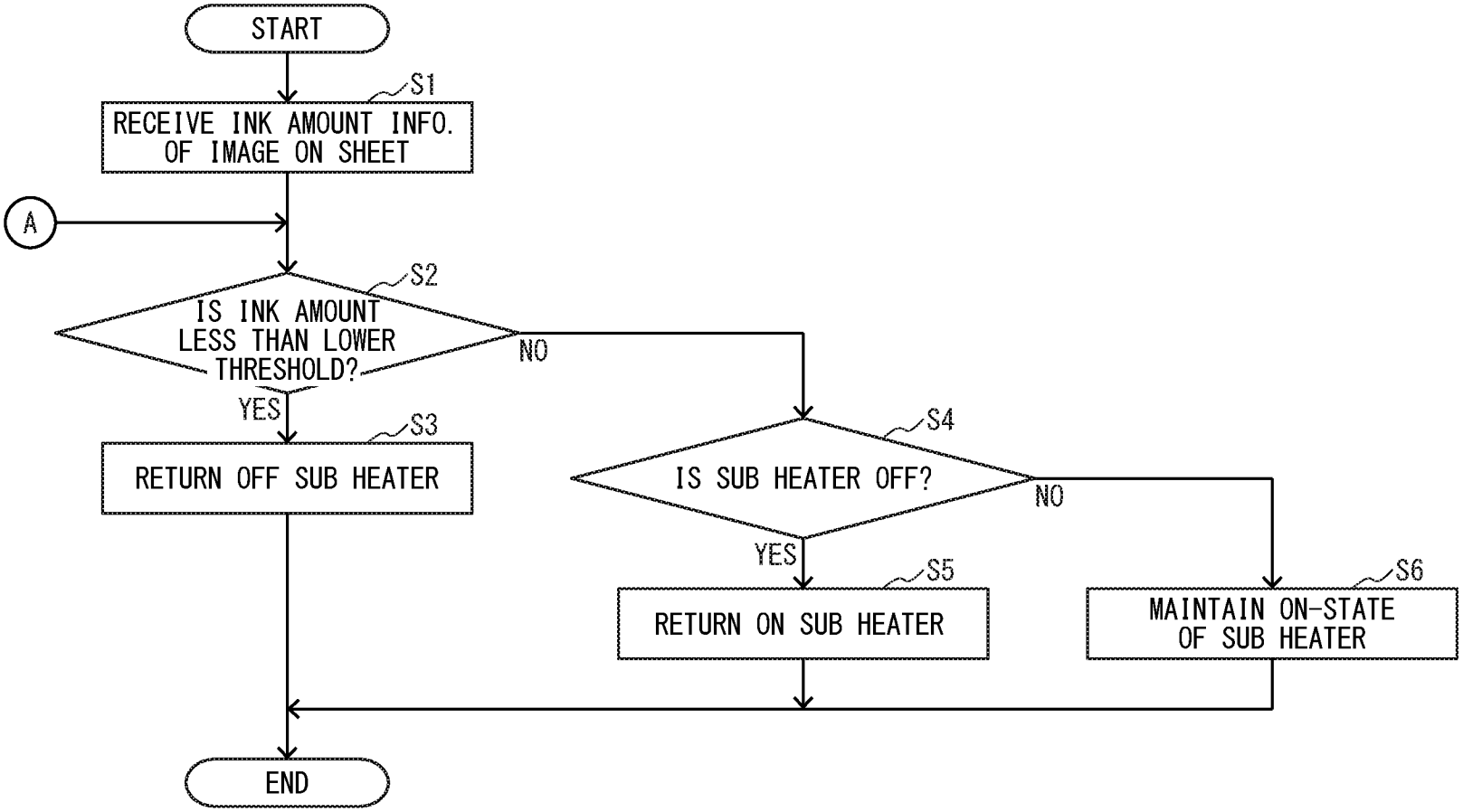
FIG. 4 is a flowchart showing operation of the relay conveyance device according to the first embodiment of the present disclosure.

Next, control operation of the main heaters 45 and 46 and the sub heaters 47, 48 and 49 by the second control device 70 according to the first embodiment will be described with reference to flowchart in FIG. 4.

First, in a condition that the sheet is not conveyed in the relay conveyance device 4, when the sheet is introduced from the relay introducing port 51, the second control device 70 may turn on (start power supply) all the main heaters 45 and 46, and the sub heaters 47, 48 and 49, simultaneously. Alternatively, since the first sheet sensor 51*a*, the seventh sheet sensor 60, the eighth sheet sensor 61, the ninth sheet sensor 62, and the sixth sheet sensor 58*a* are respectively arranged at upstream sides of the sub heater 47, the first main heater 45*a* or the second main heater 45*a*, the sub heater 48, the first main heater 46*a* or the second main heater 46*b*, and the sub heater 49 along the relay conveyance path 50, when each sheet sensor detects the sheet, the second control device 70 may turn on each heater corresponding to each sheet sensor in the order of detection. Incidentally, as described below, when an ink information amount of the sheet is less than the lower threshold, it is not necessary to turn on the sub heaters 47, 48 and 49.

When the sheet is introduced from the relay introducing port 51, the second control device 70 receives the ink information amount of the sheet from the image forming apparatus 2 via the second communicating part 71 (step S1). The second control device 70 compares the ink information amount with the lower threshold (step S2), when the ink information amount is less than the lower threshold (step S2: YES), the second control device 70 turns off (stops power supply) the sub heaters 47, 48 and during the sheet is passed through (step S3). Incidentally, on-states of the main heaters 45 and 46 are maintained.

For example, when the printing rate as the ink information amount is less than the lower threshold or the solid amount as the ink information amount is less than the lower threshold, the sub heaters 47, 48 and 49 are turned off. Concretely, since the first sheet sensor 51*a*, the eighth sheet sensor 61 and the sixth sheet sensor 58*a* are respectively arranged at the upstream sides of the sub sensors 47, 48 and 49 on the relay conveyance path 50, when each sheet sensor detects the sheet, the second control device 70 turns off each of the sub heaters 47, 48 and 49 corresponding to each sheet sensor in the order of detection.

Moreover, when the ink information amount of the sheet introduced from the relay introducing port 51 is equal to or more than the lower threshold (step S2: NO), if the sub heaters 47, 48 and 49 have been turned off during the sheet is passed through (step S4: YES), the second control device 70 turns on these sub heaters 47, 48 and 49 (step S5). Concretely, contrary to a case where the sub heater 47, 48 and 49 are turned off, when each sheet sensor detects the sheet, the second control device 70 turns on each of the sub heaters 47, 48 and 49 corresponding to each sheet sensor in the order of detection. Incidentally, when the sub heaters 47, 48 and 49 have already been turned on (step S4: NO), on-states of the sub heaters 47, 48 and 49 are maintained (step S6).

Incidentally, the second control device 70 may compare the ink information amount and the lower threshold for each sheet and control turning on and off of the sub heaters 47, 48 and 49 for each sheet, or alternatively, the second control device 70 may compare the ink information amount and the lower threshold for each job and control turning on and off of the sub heaters 47, 48 and 49 for each job.

In accordance with the first embodiment, as described above, the relay conveyance device 4 includes the relay conveyance path 50, the processing unit, the main heaters 45 and 46, and the sub heaters 47, 48 and 49. The relay conveyance path 50 is arranged between the image forming apparatus 2 forming the image on the sheet and the post processing device 3 carrying out post process to the sheet with the image formed by the image forming apparatus 2 to convey the sheet from the image forming apparatus 2 to the post processing device 3. The processing unit, such as the reversing units 41 and the correcting units 43, carries out predetermined process to the sheet at the predetermined positions on the relay conveyance path 50. The main heaters 45 and 46 heat the sheet in processing in the processing unit. The sub heaters 47, 48 and 49 heat the sheet in conveying at positions other than the predetermined positions on the relay conveyance path 50. The second control device 70 turns off the sub heaters 47, 48 and 49, when the ink information amount (an ink amount) of the image formed on the sheet is less than the predetermined lower threshold.

According to such a configuration, if it is decided that the ink amount (the printing rate and the solid amount) of the image formed on the sheet is small and that even only the main heaters 45 and 46 can sufficiently dry the ink and can sufficiently restrain the curl, it is possible to restrain power consumption by turning off the sub heaters 47, 48 and 49.

Moreover, in the first embodiment, when the sheet with the image formed with the ink amount equal to or more than the lower threshold is conveyed on the relay conveyance path 50 after the sub heaters 47, 48 and 49 are turned off, the second control device 70 turns on the sub heaters 47, 48 and 49 during (just before) the sheet is passed through the sub heaters 47, 48 and 49. Thereby, since a leading sheet not requiring the sub heaters 47, 48 and 49 is not headed by the sub heaters 47, 48 and 49 in surplus and only a sheet requiring the sub heaters 47, 48 and 49 is heated by the sub heaters 47, 48 and 49, it is possible to restrain power consumption.

Figure 5:
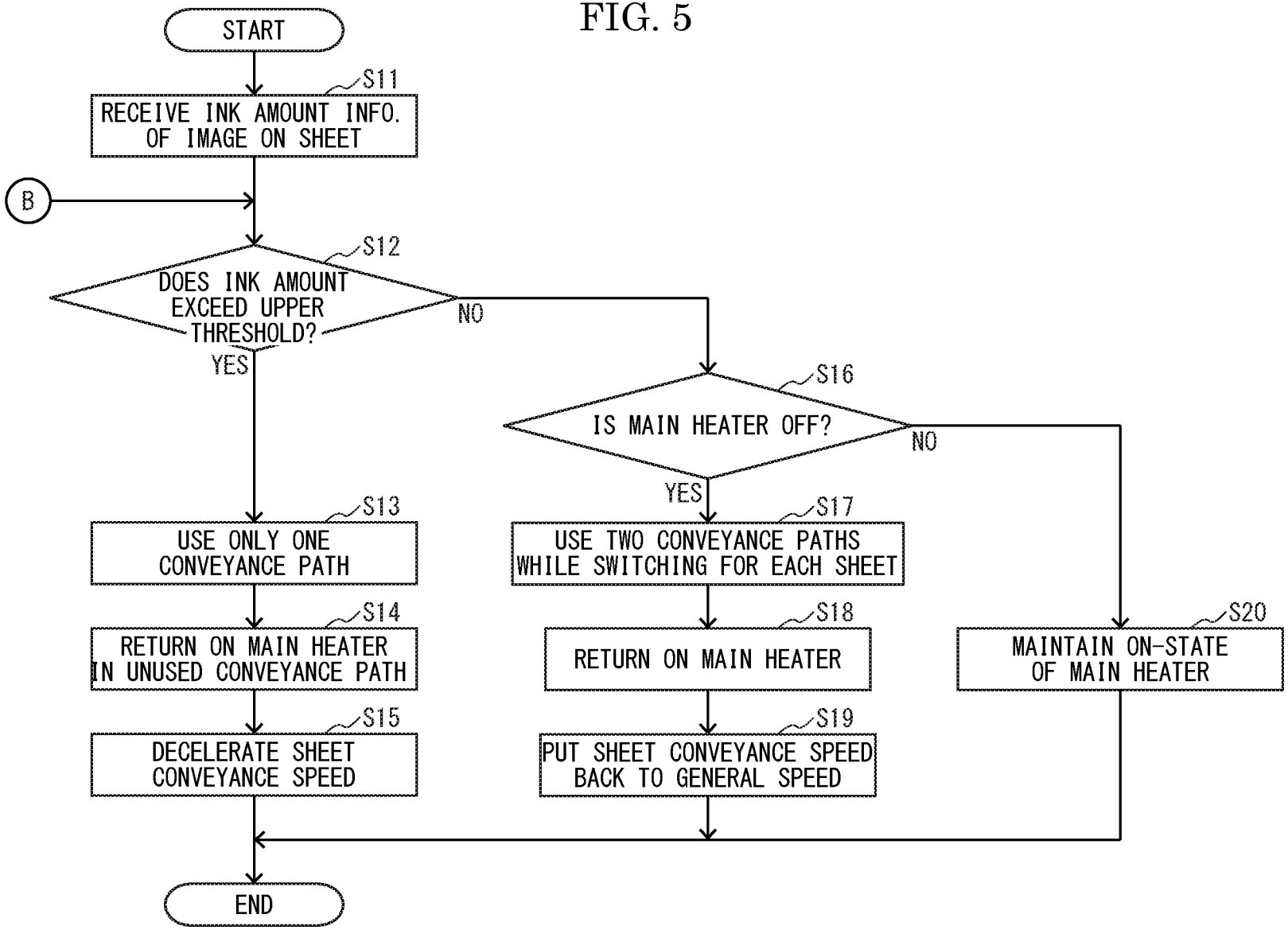
FIG. 5 is a flowchart showing operation of the relay conveyance device according to a second embodiment of the present disclosure.

The relay conveyance device 4 according to a second embodiment of the disclosure will be described. Since the relay conveyance device 4 of the second embodiment and the image forming system 1 including this relay conveyance device 4 are similar to the relay conveyance device 4 and the image forming system 1 of the first embodiment, description is omitted except for differences. In outline, although the first embodiment was described as an example turning off the sub heaters 47, 48 and 49 on the basis of comparison result of the ink amount of the image of the sheet and the lower threshold, in the second embodiment, the main heaters 45 and 46 are turned off on the basis of comparison result of the ink amount information of the image of the sheet and the upper threshold. Control operation of the main heaters 45 and 46 and the sub heaters 47, 48 and 49 by the second control device 70 according to the second embodiment will be described with reference to flowchart in FIG. 5.

In the second embodiment, when the sheet is introduced from the relay introducing port 51, the second control device 70 compares the ink information amount of the image of the sheet received from the image forming apparatus 2 with the upper threshold (step S11, step S12). When the ink information amount exceeds the upper threshold (step S12: YES), the second control device 70 controls the first junction 53 and the second junction 56 so as to use only one conveyance path (e.g. the first conveyance path C1) (step S13). Subsequently, the second control device 70 turns off (stops power supply) the main heaters 45 and 46 arranged the other conveyance path (e.g. unused conveyance path, such as the second conveyance path C2) (step S14). In this time, the second control device 70 decelerates the conveyance speed of the sheet on the relay conveyance path 50 (step S15), for example, controls the driving part 72 to set the conveyance speed in half. Incidentally, on-states of the sub heaters 47, 48 and 49 are maintained.

For example, when the printing rate as the ink amount information exceeds the upper threshold or when the solid amount as the ink amount information exceeds the upper threshold, the main heaters 45 and 46 are turned off. Concretely, since, at upstream sides from the main heaters 45 and 46 on the relay conveyance path 50, the seventh sheet sensor 60 and the ninth sheet sensor 62 are respectively arranged, when each sheet sensor detects the sheet, the second control device 70 turns off each of the main heaters 45 and 46 corresponding to each sheet sensor in the order of detection. In addition, when each sheet sensor arranged at an upstream side from each pair of rollers along the relay conveyance path 50 detects the sheet, the second control device 70 decelerates rotation speed (the conveyance speed of the sheet) of each pair of rollers corresponding to each sheet sensor in the order of detection.

Moreover, when the ink information amount of the sheet introduced from the relay introducing port 51 is equal to or less than the upper threshold (step S12: NO), if the main heaters 45 and 46 have been turned off during the sheet is passed through (step S16: YES), the second control device 70 controls the first junction 53 and the second junction 56 so as to alternately switch and to use two first conveyance path C1 and second conveyance path C2 for each sheet (step S17). Subsequently, the second control device 70 turns on the main heaters 45 and 46 (step S18). In this time, the second control device 70 controls the driving part 72 to put the conveyance speed of the sheet on the relay conveyance path 50 back to original general speed (step S19). Concretely, contrary to a case where the main heaters 45 and 46 are turned off, when each sheet sensor detects the sheet, the second control device 70 turns on each of the main heaters 45 and 46 corresponding to each sheet sensor in the order of detection. Moreover, when each sheet sensor detects the sheet, the second control device 70 puts the rotation speed of each pair of rollers corresponding to each sheet sensor back to original general speed in the order of detection and puts the conveyance speed of the sheet back to original general speed in the order of detection. Incidentally, when the main heaters 45 and 46 have already been turned on (step S16: NO), on-states of the main heaters 45 and 46 are maintained (step S20).

Incidentally, the second control device 70 may compare the ink information amount and the upper threshold for each sheet and control turning on and off of the main heaters 45 and 46 for each sheet, or alternatively, the second control device 70 may compare the ink information amount and the upper threshold for each job and control turning on and off of the main heaters 45 and 46 for each job.

In accordance with the second embodiment, as described above, the relay conveyance device 4 includes the relay conveyance path 50, at least two processing units, at least two main heaters 45 and/or at least two main heaters 46, and the sub heaters 47, 48 and 49. The relay conveyance path 50 is arranged between the image forming apparatus 2 forming the image on the sheet and the post processing device 3 carrying out post process to the sheet with the image formed by the image forming apparatus 2, includes at least two conveyance paths C1 and C2 to convey the sheet from the image forming apparatus 2 to the post processing device 3 while switching at least two conveyance paths C1 and C2 for each sheet. The at least two processing units, such as the first reversing unit 41*a* and the second reversing unit 41*b* and/or the first correcting unit 43*a* and the second correcting unit 43*b*, are respectively arranged on the at least two conveyance paths C1 and C2 to carry out predetermined process to the sheet at the predetermined positions on the at least two conveyance paths C1 and C2. The at least two main heaters 45, such as the first main heater 45*a* and the second main heater 45*b*, and/or at least two main heaters 46, such as the first main heater 46*a* and the second heater 46*b*, heat the sheet in processing in the at least two processing units. The sub heaters 47, 48 and 49 heat the sheet in conveying at positions other than the at least two conveyance paths C1 and C2 on the relay conveyance path 50. The second control device 70 of the relay conveyance device 4 carries out sheet conveyance by using only one conveyance path C1 or C2 of the at least two conveyance paths C1 and C2, decelerates the conveyance speed of the sheet on the relay conveyance path 50, and turns off the main heater 45 or 46 corresponding to the processing unit arranged on the other conveyance path C2 or C1 when the ink information amount (an ink amount) of the image formed on the sheet exceeds the predetermined upper threshold.

According to such a configuration, if the ink amount (the printing rate and the solid amount) of the image formed on the sheet is large, by decelerating the conveyance speed of the sheet, it is possible to sufficiently dry the ink and to sufficiently restrain the curl. Further, by using only one conveyance path of the plurality of conveyance C1 and C2, using only one main heater 45 and one main heater 46 on the one conveyance path, and turning off the other main heater 45 and the other main heater 46, it is possible to restrain power consumption.

Figure 6:
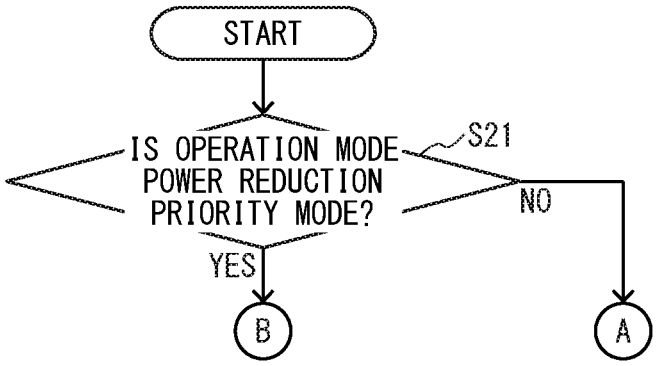
FIG. 6 is a flowchart showing operation of the relay conveyance device according to another embodiment of the present disclosure.

Moreover, in another embodiment, the relay conveyance device 4 may be configured to run while switching any one operation mode between a normal mode and a power reduction priority mode. Control operation of the second control device 70 according to another embodiment will be described with reference to flowchart in FIG. 6.

In a case where the operation mode is the power reduction priority mode (step S21: YES), as the second embodiment described above (step B, steps S12-S20 in FIG. 5), the relay conveyance device 4 turns off the main heaters 45 and 46 on the basis of comparison result of the ink amount of the image of the sheet and the upper threshold. On the other hand, in a case where the operation mode is the normal mode, the relay conveyance device 4 runs while maintaining on-states of the main heaters 45 and 46 and the sub heaters 47, 48 and 49 regardless of the ink amount information (the ink amount) of the image formed on the sheet. Alternatively, in the case where the operation mode is the normal mode (step S21: YES), as the first embodiment described above, the relay conveyance device 4 turns off the sub heaters 47, 48 and 49 on the basis of comparison result of the ink amount of the image of the sheet and the lower threshold (step A, steps S2-S6 in FIG. 4).

When a user suitably sets such an operation mode, it is possible to select use of the main heaters 45 and 46 and the sub heaters 47, 48 and 49 according to convenience of the user.

Although the embodiments was described as example about a case applying the relay conveyance device 4 of the present disclosure to the image forming system 1 including the ink-jet type image forming apparatus 2, the disclosure is not restricted by this example, and the disclosure may be applied to, for example, another image forming system including another image forming apparatus.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A relay conveyance device comprising:

a relay conveyance path being arranged between an image forming apparatus forming an image on a sheet and a post processing device carrying out post process to the sheet with the image formed by the image forming apparatus to convey the sheet from the image forming apparatus to the post processing device;

a processing unit carrying out predetermined process to the sheet at a predetermined position on the relay conveyance path;

a main heater heating the sheet in processing in the processing unit; and a sub heater heating the sheet in conveying at a position other than the predetermined position on the relay conveyance path, wherein when an ink amount of the image formed on the sheet is less than a predetermined lower threshold, the sub heater is turned off.

2. The relay conveyance device according to claim 1, wherein when the sheet with the image formed with the ink amount equal to or more than the lower threshold is conveyed on the relay conveyance path after the sub heater is turned off, the sub heater is turned on just before the sheet is passed through the sub heater.

3. The relay conveyance device according to claim 1, wherein the processing unit includes a reversing unit reversing the sheet and a correcting unit correcting a position of the sheet.

4. A relay conveyance device comprising:

a relay conveyance path being arranged between an image forming apparatus forming an image on a sheet and a post processing device carrying out post process to the sheet with the image formed by the image forming apparatus, including at least two conveyance paths to convey the sheet from the image forming apparatus to the post processing device while switching at least two conveyance paths for each sheet;

at least two processing units being arranged on the at least two conveyance paths to carry out predetermined process to the sheet at the predetermined positions on the at least two conveyance paths, respectively;

at least two main heaters heating the sheet in processing in the at least two processing units, respectively; and a sub heater heating the sheet in conveying at positions other than the at least two conveyance paths on the relay conveyance path, wherein when an ink amount of the image formed on the sheet exceeds a predetermined upper threshold, sheet conveyance is carried out by using only one conveyance path of the at least two conveyance paths, conveyance speed of the sheet on the relay conveyance path is decelerated, and the main heater corresponding to the processing unit arranged on the other conveyance path is turned off.

5. The relay conveyance device according to claim 4, wherein in a case where an operation mode is a power reduction priority mode, the main heaters are turned off on the basis of comparison result of the ink amount and the upper threshold, on the other hand, in a case where the operation mode is a normal mode, the relay conveyance device runs while maintaining on-states of the main heaters regardless of the ink amount.

6. The relay conveyance device according to claim 4, wherein in a case where an operation mode is a power reduction priority mode, the main heaters are turned off on the basis of comparison result of the ink amount and the upper threshold, on the other hand, in a case where the operation mode is a normal mode, when the ink amount is less than a predetermined lower threshold, the sub heater is turned off.

7. The relay conveyance device according to claim 4, wherein the processing unit includes a reversing unit reversing the sheet and a correcting unit correcting a position of the sheet.

* * * * *